US006032396A

United States Patent [19]

Shapiro

[11] Patent Number: 6,032,396

[45] Date of Patent: Mar. 7, 2000

[54] CHILD SAFE TRIGGER MECHANISM

[76] Inventor: Edward Shapiro, 8 Silver Eagle Rd., Rolling Hills Estates, Calif. 90274

[21] Appl. No.: 09/074,166

[22] Filed: May 7, 1998

[51] Int. Cl.[7] ..... F41A 17/00

[52] U.S. Cl. ..... 42/70.06; 42/70.11; 42/70.01

[58] Field of Search ..... 42/69.01, 70.01, 42/70.04, 70.06, 70.07, 70.11, 66

[56] References Cited

U.S. PATENT DOCUMENTS

| | | | |
|---|---|---|---|
| 1,470,029 | 10/1923 | Pedersen | 42/16 |
| 2,046,996 | 7/1936 | Berdon | 42/69.01 |
| 2,191,521 | 2/1940 | Crockett | 42/70.01 |
| 2,881,547 | 4/1959 | Butler | 42/16 |
| 3,153,874 | 10/1964 | Merrill | 42/41 |
| 3,188,764 | 6/1965 | Harding | 42/69.01 |
| 4,449,312 | 5/1984 | Ruger et al. | 42/66 |
| 4,621,445 | 11/1986 | Rohm | 42/66 |
| 4,628,626 | 12/1986 | Brandt | 42/70.01 |
| 4,825,576 | 5/1989 | Troncoso et al. | 42/70.07 |

*Primary Examiner*—Charles T. Jordan
*Assistant Examiner*—Jeffrey Howell

[57] ABSTRACT

A new child safe trigger mechanism for preventing a child from squeezing the trigger of a handgun. The inventive device includes a gun having a trigger, a trigger guard, and a handgrip. A base member is extended from a portion of the trigger guard adjacent the handgrip towards the trigger. The base member has a threaded bore therein facing the trigger. An insert member is threadedly inserted into the bore of the base member. An abutment member is slidably inserted into hole in the first end of the insert member so that the first end of the abutment member abuts the trigger. The abutment member is biased towards the trigger so that a predetermined amount of opposing force is required for moving the abutment member towards the second end of the insert member to overcome the biasing force.

4 Claims, 2 Drawing Sheets

CHILD SAFE TRIGGER MECHANISM

BACKGROUND OF THE INVENTION

1. Field of the Invention

The present invention relates to safety devices for handguns and more particularly pertains to a new child safe trigger mechanism for preventing a child from squeezing the trigger of a handgun.

2. Description of the Prior Art

The use of safety devices for handguns is known in the prior art. More specifically, safety devices for handguns heretofore devised and utilized are known to consist basically of familiar, expected and obvious structural configurations, notwithstanding the myriad of designs encompassed by the crowded prior art which have been developed for the fulfillment of countless objectives and requirements.

Known prior art safety devices for handguns include U.S. Pat. No. 4,030,221; U.S. Pat. No. 1,569,553; U.S. Pat. No. Des. 335,519; U.S. Pat. No. 3,492,748; U.S. Pat. No. 5,433,028; and U.S. Pat. No. 5,437,119.

While these devices fulfill their respective, particular objectives and requirements, the aforementioned patents do not disclose a new child safe trigger mechanism. The inventive device includes a gun having a trigger, a trigger guard, and a handgrip. A base member is extended from a portion of the trigger guard adjacent the handgrip towards the trigger. The base member has a threaded bore therein facing the trigger. An insert member is threadedly inserted into the bore of the base member. An abutment member is slidably inserted into hole in the first end of the insert member so that the first end of the abutment member abuts the trigger. The abutment member is biased towards the trigger so that a predetermined amount of opposing force is required for moving the abutment member towards the second end of the insert member to overcome the biasing force.

In these respects, the child safe trigger mechanism according to the present invention substantially departs from the conventional concepts and designs of the prior art, and in so doing provides an apparatus primarily developed for the purpose of preventing a child from squeezing the trigger of a handgun.

SUMMARY OF THE INVENTION

In view of the foregoing disadvantages inherent in the known types of safety devices for handguns now present in the prior art, the present invention provides a new child safe trigger mechanism construction wherein the same can be utilized for preventing a child from squeezing the trigger of a handgun.

The general purpose of the present invention, which will be described subsequently in greater detail, is to provide a new child safe trigger mechanism apparatus and method which has many of the advantages of the safety devices for handguns mentioned heretofore and many novel features that result in a new child safe trigger mechanism which is not anticipated, rendered obvious, suggested, or even implied by any of the prior art safety devices for handguns, either alone or in any combination thereof.

To attain this, the present invention generally comprises a gun having a trigger, a trigger guard, and a handgrip. A base member is extended from a portion of the trigger guard adjacent the handgrip towards the trigger. The base member has a threaded bore therein facing the trigger. An insert member is threadedly inserted into the bore of the base member. An abutment member is slidably inserted into hole in the first end of the insert member so that the first end of the abutment member abuts the trigger. The abutment member is biased towards the trigger so that a predetermined amount of opposing force is required for moving the abutment member towards the second end of the insert member to overcome the biasing force.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new child safe trigger mechanism apparatus and method which has many of the advantages of the safety devices for handguns mentioned heretofore and many novel features that result in a new child safe trigger mechanism which is not anticipated, rendered obvious, suggested, or even implied by any of the prior art safety devices for handguns, either alone or in any combination thereof.

It is another object of the present invention to provide a new child safe trigger mechanism which may be easily and efficiently manufactured and marketed.

It is a further object of the present invention to provide a new child safe trigger mechanism which is of a durable and reliable construction.

An even further object of the present invention is to provide a new child safe trigger mechanism which is susceptible of a low cost of manufacture with regard to both materials and labor, and which accordingly is then susceptible of low prices of sale to the consuming public, thereby making such child safe trigger mechanism economically available to the buying public.

Still yet another object of the present invention is to provide a new child safe trigger mechanism which provides in the apparatuses and methods of the prior art some of the advantages thereof, while simultaneously overcoming some of the disadvantages normally associated therewith.

Still another object of the present invention is to provide a new child safe trigger mechanism for preventing a child from squeezing the trigger of a handgun.

Yet another object of the present invention is to provide a new child safe trigger mechanism which includes a gun having a trigger, a trigger guard, and a handgrip. A base member is extended from a portion of the trigger guard adjacent the handgrip towards the trigger. The base member has a threaded bore therein facing the trigger. An insert member is threadedly inserted into the bore of the base member. An abutment member is slidably inserted into hole in the first end of the insert member so that the first end of the abutment member abuts the trigger. The abutment member is biased towards the trigger so that a predetermined amount of opposing force is required for moving the abutment member towards the second end of the insert member to overcome the biasing force.

Still yet another object of the present invention is to provide a new child safe trigger mechanism that while preventing a child from squeezing the trigger of a handgun, permits squeezing of the trigger by an adult.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
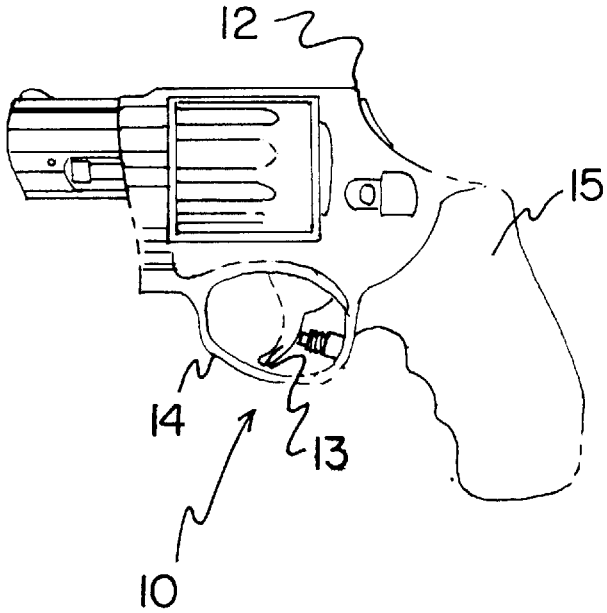
FIG. 1 is a schematic side view of a new child safe trigger mechanism on a handgun according to the present invention.
Figure 2:
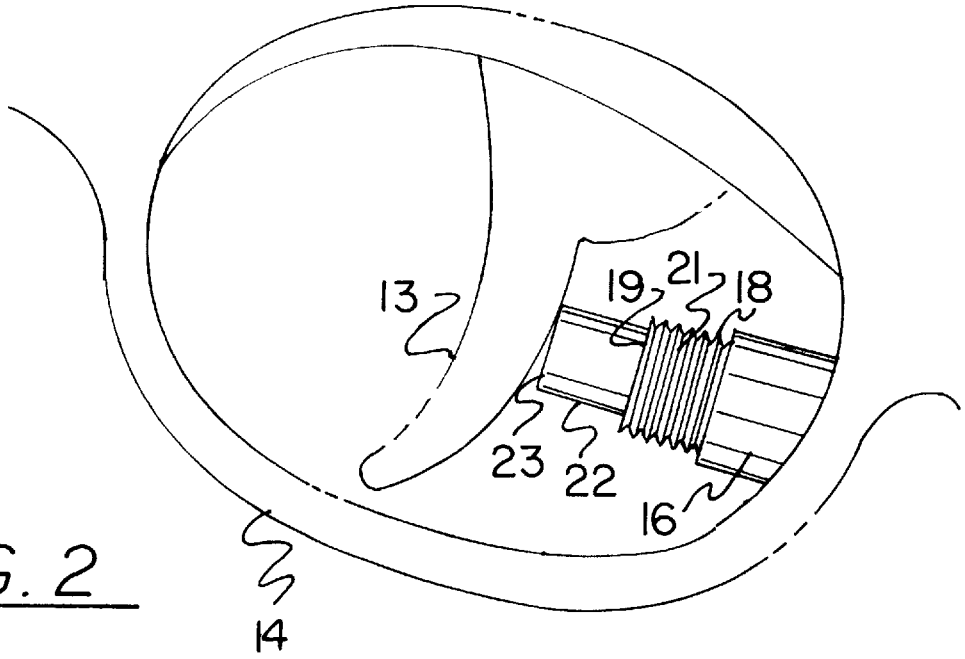
FIG. 2 is a schematic side view of the trigger region of the present invention.
Figure 3:
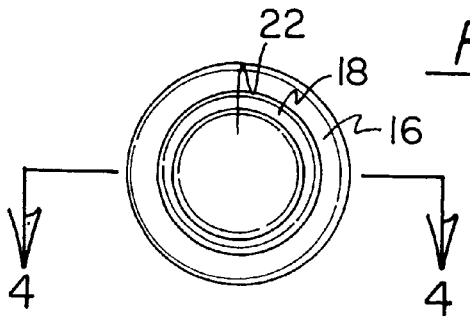
FIG. 3 is a schematic end view of the present invention as seen from the first end of the abutment member.
Figure 4:
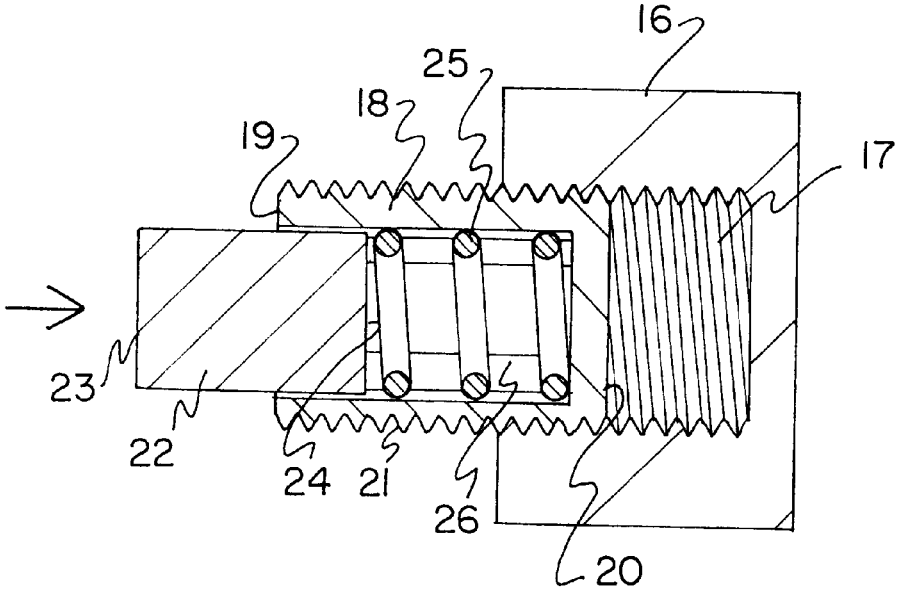
FIG. 4 is a schematic cross-sectional view of the present invention taken from line 4—4 of FIG. 3.

With reference now to the drawings, and in particular to FIGS. 1 through 4 thereof, a new child safe trigger mechanism embodying the principles and concepts of the present invention and generally designated by the reference numeral 10 will be described.

As best illustrated in FIGS. 1 through 4, the child safe trigger mechanism 10 generally comprises a gun 12 having a trigger 13, a trigger guard 14, and a handgrip 15. A base member 16 is extended from a portion of the trigger guard 14 adjacent the handgrip 15 towards the trigger 13. The base member 16 has a threaded bore 17 therein facing the trigger 13. An insert member 18 is threadedly inserted into the bore 17 of the base member 16. An abutment member 22 is slidably inserted into hole 26 in the first end 19 of the insert member 18 so that the first end 23 of the abutment member 22 abuts the trigger 13. The abutment member 22 is biased towards the trigger 13 so that a predetermined amount of opposing force is required for moving the abutment member 22 towards the second end 20 of the insert member 18 to overcome the biasing force.

In closer detail, the handgun has a trigger 13, a trigger guard 14, and a handgrip 15. A base member 16 is extended from a portion of the trigger guard 14 adjacent the handgrip 15 towards the trigger 13. The base member 16 has a threaded cylindrical bore 17 therein facing the trigger 13.

An insert member 18 is provided having opposite first and second ends 19,20, and a threaded outer surface 21. The first end 19 of the insert member 18 has a hole 26 in it. The hole 26 is generally cylindrical and extends from the first end 19 of the insert member 18 towards the second end 20 of the insert member 18. The second end 20 of the insert member 18 is threadedly inserted into the bore 17 of the base member 16. The insert member 18 may be screwed into the bore so that the amount of the insert member 18 extending outwards from the bore 17 of the base member 16 may be adjusted. Preferably, the insert member 18 may not be easily removed from the bore. This may be done with some sort of an adhesive compound or by constructing the insert member to function as a one-way screwing fastener (such as having a one way screw slot on the first end 19 or designing the insert member like a locking lug nut) to prevent easy removal of the insert member 18 from the bore 17 of the base member 16.

The abutment member 22 is generally cylindrical and has opposite first and second ends 23,24. The second end 24 of the abutment member 22 is slidably inserted into the hole 26 of the first end 19 of the insert member 18 so that the first end 23 of the abutment member 22 abuts the back of the trigger 13. Optionally, the first end 23 of the abutment member 22 may be V-shaped or U-shaped such that the first end 23 of the abutment member 22 cradles the trigger 13.

The abutment member 22 is biased in the hole 26 of the first end 19 of the insert member 18 away from the second end 20 of the insert member 18 towards the first end 19 of the insert member 18. The abutment member is biased by a predetermined amount of force towards the trigger 13 such that a child may not squeeze the trigger 13 but so that an adult may squeeze the trigger 13. Preferably, a spring 25 is provided in the bore 17 between the second end 20 of the insert member 18 and the second end 24 of the abutment member 22. The spring 25 bias the abutment member 22 towards the trigger 13 away from the second end 20 of the insert member 18 towards the first end 19 of the insert member 18. As mentioned previously, in use a predetermined amount of opposing force is required for moving the abutment member 22 towards the second end 20 of the insert member 18 to overcome the biasing force provided by the spring 25.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, failing within the scope of the invention.

I claim:

1. A safety device for a handgun, comprising:

a gun having a trigger, a trigger guard, and a handgrip;

a base member being extended from a portion of said trigger guard adjacent said handgrip towards said trigger;

said base member having a threaded bore therein facing said trigger;

an insert member having opposite first and second ends, and a threaded outer surface;

said first end of said insert member having a hole therein, said hole being extended from said first end of said insert member towards said second end of said insert member;

said second end of said insert member being threadedly inserted into said bore of said base member;

an abutment member being generally cylindrical and having opposite first and second ends, said second end of said abutment member being slidably inserted into said hole of said first end of said insert member, said first end of said abutment member abutting said trigger;

said abutment member being biased outwardly away from said base member and towards said trigger, wherein a predetermined amount of opposing force is required for moving said abutment member towards said second end of said insert member to overcome the biasing force such that said base member abuts against said trigger guard and said abutment member abuts a lower portion of said trigger simultaneously to provide consistent resistance to trigger movement throughout the entire pull of a trigger.

2. The safety device of claim 1, wherein said hole is generally cylindrical and said abutment member is generally cylindrical.

3. The safety device of claim 1, wherein a spring is provided in said bore between said second end of said insert member and said second end of said abutment member, said spring biasing said abutment member towards said trigger such that a predetermined amount of opposing force is required for moving said abutment member towards said second end of said insert member to overcome the biasing force provided by said spring.

4. A safety device for a handgun, comprising:

a gun having a trigger, a trigger guard, and a handgrip;

a base member being extended from a portion of said trigger guard adjacent said handgrip towards said trigger;

said base member having a threaded bore therein facing said trigger;

an insert member having opposite first and second ends, and a threaded outer surface;

said first end of said insert member having a hole therein, said hole being generally cylindrical and being extended from said first end of said insert member towards said second end of said insert member;

said second end of said insert member being threadedly inserted into said bore of said base member;

an abutment member being generally cylindrical and having opposite first and second ends, said second end of said abutment member being slidably inserted into said hole of said first end of said insert member, said first end of said abutment member abutting said trigger;

said abutment member being biased outwardly away from said base member and towards said trigger, wherein a spring is provided in said bore between said second end of said insert member and said second end of said abutment member, said spring biasing said abutment member towards said trigger, wherein a predetermined amount of opposing force is required for moving said abutment member towards said second end of said insert member to overcome the biasing force provided by said spring such that said base member abuts against said trigger guard and said abutment member abuts a lower portion of said trigger simultaneously to provide consistent resistance to trigger movement throughout the entire pull of a trigger.

* * * * *